US005314607A

United States Patent [19]

Kaneko et al.

[11] Patent Number: 5,314,607

[45] Date of Patent: May 24, 1994

[54] APPARATUS AND METHOD FOR ANODIZING SUPPORTS FOR LITHOGRAPHIC PRINTING PLATE

[75] Inventors: Nobuyoshi Kaneko; Tsutomu Kakei; Akio Uesugi, all of Shizuoka, Japan

[73] Assignee: Fuji Photo Film Co., Ltd., Kanagawa, Japan

[21] Appl. No.: 901,674

[22] Filed: Jun. 22, 1992

[30] Foreign Application Priority Data

Jun. 21, 1991 [JP] Japan ..... 3-150083
Nov. 6, 1991 [JP] Japan ..... 3-289849

[51] Int. Cl.[5] ..... C25D 5/00

[52] U.S. Cl. ..... 205/139; 204/206

[58] Field of Search ..... 204/140, 144.5, 434, 204/206; 205/139, 147

[56] References Cited

U.S. PATENT DOCUMENTS

| | | | |
|---|---|---|---|
| Re. 29,754 | 9/1978 | Fromson | 205/147 |
| Re. 31,901 | 5/1985 | Kawai et al. | 205/147 |
| 3,691,030 | 9/1972 | Stroszynski | 205/139 |
| 5,094,733 | 3/1992 | Kaneko et al. | 204/206 |

FOREIGN PATENT DOCUMENTS

| | | |
|---|---|---|
| 48-26638 | 4/1973 | Japan . |
| 56-142891 | 11/1981 | Japan . |
| 5747894 | 3/1992 | Japan . |

OTHER PUBLICATIONS

"Electroplating" Book of Frederick A. Lowenhein pp. 452-3 (1979), published by American Electroplaters' Society.

*Primary Examiner*—John Niebling
*Assistant Examiner*—Brendan Mee
*Attorney, Agent, or Firm*—Sughrue, Mion, Zinn, Macpeak & Seas

[57] ABSTRACT

An apparatus for anodizing a support for a lithographic printing plate which comprises a backing roller which guides a web made of aluminum or an alloy thereof in a state of contacting the backing roller, (an) electrode(s) which is/are arranged along the peripheral surface of the backing roller in a concentric arc, an electric supplier which is provided at least on the upstream side or the downstream side of the backing roller, and an electrolyte solution which fills the clearance between the backing roller and the electrode, and an anodizing method using the same. By using the apparatus, the electric voltage loss can be reduced in electrolyte solution, and only a single surface of the supports is anodized without the necessity for providing any special means. Anodizing can be conducted at a high speed and the thickness of anodized layer easily increased. Moreover, thin supports can be anodized without fusion troubles.

8 Claims, 2 Drawing Sheets

APPARATUS AND METHOD FOR ANODIZING SUPPORTS FOR LITHOGRAPHIC PRINTING PLATE

BACKGROUND OF THE INVENTION

This invention relates to an apparatus and a method for anodizing supports for a lithographic printing plate, particularly made of aluminum or an alloy thereof of which the surface is roughened mechanically, chemically or electrochemically.

In general, aluminum supports used for lithographic printing plate are required to be excellent in hydrophilic property and water retention, and accordingly, the surface of the aluminum substrate is finely roughened by a mechanical, chemical or electrochemical method. Furthermore, it is usually conducted to anodize the roughened surface in order to improve mechanical strength and water retention of the surface.

A conventional anodizing of a support for lithographic printing plate was conducted by the anodizing method disclosed in Japanese Patent KOKAI Nos. 48-26638 and 47-18739 and Japanese Patent KOKOKU No. 58-24517, and the method is usually called as the submerged power supply system. An apparatus for anodizing according to the submerged power supply system is shown in FIG. 4. The anodizing apparatus shown in FIG. 4 composed of three parts, i.e. a power supply part 2 for charging an aluminum web 1 with negative charge, an anodizing part 3 for the anodizing treatment of the aluminum web 1 charged with positive charge and an intermediate part 4 for preventing a short circuit in the liquid between the power supply part 2 and the anodizing part 3. A power supply electrode 5 and an electrolysis electrode 6 are disposed in the electrolyte solution of the power supply part 2 and the anodizing part 3 respectively, and the power supply electrode 5 is connected to the electrolysis electrode 6 through a direct current source 7.

In the apparatus for anodizing treatment, the electric current from the direct current source 7 flows to the aluminum product 1 through the electrolyte solution from the power supply electrode 5 in the power supply part 2, and the electric current flows to the anodizing part 3 in the aluminum web 1. Thus, an anodized layer is formed on the surface of the aluminum web 1.

However, the electric voltage loss in the above anodizing treatment was considerably great, and could not be neglected. That is, when the distance between the electrode and the aluminum web is small at the power supply part and the anodizing part, quality troubles, such as flaw and spark, tend to occur by flapping or unstable travel of the aluminum web resulting in contact with the electrode. Therefore, the distance between the electrode and the aluminum web must be rendered great in order to prevent the quality troubles, and the distance is usually necessary to be larger than 50 mm. As a result, the electric voltage loss becomes great.

Additionally, in the conventional method, since both surfaces of the aluminum web are dipped in the electrolyte solution, electric current goes around the opposite surface not to be intended to be provided with anodizing treatment to form an anodized layer. Therefore, in the case of manufacturing single surface treated web, it is necessary to provide a special means for preventing the electric current from going around the non treatment surface of the aluminum web, such as disclosed in Japanese Patent KOKAI No. 57-47894.

Moreover, the speedup of the anodizing line and the increase in a thickness of the anodized layer cannot be conducted in low cost. That is, in the case that the electrolytic treatment line is speeded up for improving productivity and in the case that the thickness of the anodized layer is increased for improving quality, the amount of supply current must be increased. Attendantly, voltage drop caused by ohmic loss is increased in the aluminum web with increasing supply current. Therefore, an increase in electrolytic voltage of source is necessary.

When the electrolytic voltage is increased, electric energy running cost is increased due to the increase of electric energy used. Since the source capacity is necessary to be increased, the plant investment is increased. Besides, since the electrolytic voltage is great, Joule heat is greatly generated in the aluminum web between the power supply electrode 5 and the electrolysis electrode 6. As a result, the cooling cost for cooling the aluminum web and the electrolyte solution to a prescribed normal temperature increases. As described above, when an electrolytic treatment line is speeded up in the conventional apparatus, the cost becomes great.

In the case of thin aluminum web, the speedup of the electrolytic treatment line is difficult. That is, since the whole current supplied by a power source flows into the aluminum article at the intermediate part between the power supply part and the anodizing part, when the amount of supplied current in great, the thin aluminum web heats up greatly and fuses. Therefore, in the case of the thin aluminum web, there is a limit in the amount of current supply. As a result, the speedup of an electrolytic treatment line and the increase in the thickness of an anodized layer are difficult.

SUMMARY OF THE INVENTION

An object of the invention is to provide an apparatus and a method for anodizing a support for a lithographic printing plate capable of reducing the electric voltage loss in electrolyte solution without the necessity for providing any special means, even in the case of anodizing only a single surface of the support.

Another object of the invention is to provide an apparatus and a method for anodizing a support for a lithographic printing plate capable of anodizing at a high speed and capable of increasing the quantity of anodized layer easily.

Another object of the invention is to provide an apparatus and a method for anodizing a support for a lithographic printing plate capable of anodizing a thin support without fusion troubles.

The present invention provides an apparatus and a method for anodizing a support for a lithographic printing plate which have achieved the above objects.

The apparatus comprises a backing roller which guides a web made of aluminum or an alloy thereof in a state of contacting the backing roller, at least one electrode which is arranged along the peripheral surface of the backing roller in a concentric arc, an electric current supplier which is provided at least on the upstream side or the downstream side of the backing roller, and an electrolyte solution which fills the space between the backing roller and the electrode.

The method comprises guiding a web made of aluminum or an alloy thereof with contacting the backing roller and with being dipped in the electrolyte solution, and applying electric current to the arc-formed electrode(s) and the electric current supplier.

Figure 1:
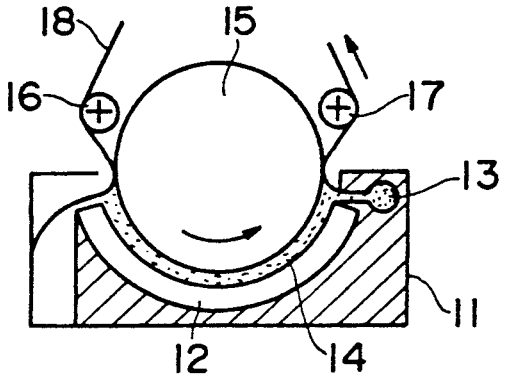
FIGS. 1 and 2 are a schematic section of apparatuses embodying the invention wherein guide rollers are used as the electric current supplier.

| | |
|---|---|
| 11 | Anodizing bath |
| 12 | Electrode |
| 13 | Inlet passage of electrolyte solution |
| 14 | Electrolyte solution |
| 15 | Backing roller |
| 16,17 | Guide roller |
| 18 | Aluminum web |
| 20,21 | Feeding cell |
| 22,23 | Feeding solution |
| 24,25 | Feeding electrode |
| 26,27,28,29 | Roller |

DETAILED DESCRIPTION OF THE INVENTION

The electric current supplier supplies electric current from the power source to the web, and includes a guide roller and a feeding cell.

The guide roller is freely rotatable, and connected to the power supply. The guide roller may touch either surface of the web, i.e. the surface to be treated (on which anodized layer is formed) or the opposite surface (on which anodized layer is not formed). The preferred surface is the opposite surface, because fine roughness is already formed on the surface to be treated by roughening conducted in a previous process. As a result, the contact of the guide roller to the surface to be treated of the web becomes uneven, and electric current is concentrated to the contact portion resulting in the occurrence of quality troubles such as spark. The quality troubles are liable to occur particularly in the case of increasing electric current in order to conduct a high speed and high efficiency treatment. Moreover, in the case of disposing the guide roller on the downstream side of the backing roller, the electric current is fed through the anodized layer resulting in the occurrence of flaw troubles as well as electric voltage loss. The above problems can be resolved by disposing the guide rollers on both the upstream and downstream sides of the backing roller; an excellent anodized layer is stably formed even in a high speed treatment and a thick layer treatment.

The feeding cell is provided with a feeding electrode, and a feeding solution is put therein. The feeding electrode is provided at least against single surface of the web, and is preferably provided against both surfaces in order to render the cell compact. The clearance between the feeding electrode and the web is preferably in the range of 2 to 100 mm. Usable electrodes as the feeding electrode are lead electrode, zinc dioxide electrode, ferrite electrode, platinum electrode, platinum-plated titanium electrode, titanium electrode with platinum cladding, aluminum electrode, etc. The feeding solution has conductivity, and may be identical with or different from the electrolyte solution described later in terms of its composition, concentration, temperature and the like. The feeding cell is superior to the guiding roller, because various problems induced by touching the web do not occur. Anodizing treatment can be conducted stably at a high speed and the thickness of anodized layer can easily be thickened.

The electric supplier is provided at least on one of the upstream side and the downstream side of the backing roller, and to be provided on both sides is preferred. By providing the electric supplier on both sides, electric current is supplied to the web through two routes, i.e. through the upstream side and the downstream side, the electric current quantity can be decreased to a half compared with the conventional means. This is particularly effective in a high speed treatment. That is, heat generation decreases resulting in the reduction of cooling load, and running cost is sharply lowered. The power supply equipment may be compact. Moreover, in the case of thin web, it can be anodized stably without fusion.

The backing roller guides the web in a state such that only a single surface of the web is dipped in the electrolyte solution. The backing roller may either be merely freely rotatable or be provided with a driving mechanism. The peripheral surface of the backing roller is covered by insulating material such as rubbers.

The electrode is arranged along the peripheral surface of the backing roller, and the clearance therebetween is preferably 1 to 40 mm, more preferably 5 to 20 mm. The material of the electrode may be selected from those for the feeding electrode.

The web is made of pure aluminum or an alloy of aluminum with silicon, iron, copper, manganese, magnesium, chromium, zinc, bismuth, nickel or the like. The thickness of the web is usually 0.1 to 0.5 mm.

The electrolyte solution may be aqueous sulfuric acid solution, aqueous phosphoric acid solution, aqueous oxalic acid solution, an aqueous salt solution thereof and mixture solution thereof, and a solution suitable for obtaining a desired quality is selected among them. The temperature and concentration of the electrolyte solution can be arbitrarily selected. The electrolyte solution and the feeding solution are prefeably in a flow state.

The wave form of the power source is selected from direct current wave forms, alternating current wave forms, direct-alternating superposition wave forms and the like so as to achieve a desired quality. The current density during anodizing is also arbitrary, and it may be stationary or may be varied, for example, gradually increased.

The web to be treated with anodizing is, generally, previously provided with roughening in order to improve water retention and adhesion of the photosensitive material applied thereonto. The roughening is conducted by a process of mechanical roughening, a chemical roughening, electrochemical roughening or a combination thereof. For the mechanical roughening process, there are wire brush graining, brush graining, sandblasting, ball graining and the like. For the chemical roughening process, there are a method of dissolving the surface selectively and the like. For the electrochemical roughening process, there are a method of using nitric acid, hydrochloric acid, a mixture of both acids as the electrolyte. A salt, such as aluminum nitrate, aluminum chloride, ammonium nitrate, ammonium chloride, manganese nitrate, manganese chloride, iron nitrate, or iron chloride, may be added thereto. An aqueous solution of neutral salt, such as sodium chloride or soldium nitrate, may also be used as the electrolyte.

In addition, alkali etching, neutralization, removed any smut (composed primarily of aluminum hydroxide) and the like may be conducted between the roughening and the anodizing, if necessary.

The aforementioned apparatus is used as one unit; two or more units may be connected in series to repeat anodizing.

After anodizing, the web may optionally be provided with the sealing treatment disclosed in Japanese Patent KOKAI No. 1-150583, the treatment rendering hydrophilic disclosed in Japanese Patent KOKAI No. 60-149491, the alkali metal silicate aqueous solution treatment disclosed in U.S. Pat. No. 3,181,461, the undercoat layer coating of hydrophilic cellulose containing a water-soluble metal salt disclosed in U.S. Pat. No. 3,860,426 and the like.

The anodized support is provided with a photosensitive layer on the surface to form photosensitive lithographic printing plates. The photosensitive layer may be composed of a diazo resin composition, an o-quinone diazo compound composition, a photopolymerizable composition, a composition of a photosensitive resin having unsaturated double bond in the molecule, or the like.

In the invention, by anodizing the web while it contacts the backing roller, electric current is prevented from flowing into the opposite surface, and thereby an anodized layer is not formed on the opposite surface. Flapping of the traveling web is also prevented, and thereby, the web can be made close to the electrode. When the feeding cell is used as the electric supplier, the feeding cell intermediates between the web and the feeding electrode, and electric current is fed to the web in the state of not contacting the feeding electrode.

According to the invention, since anodizing can be conducted at a lower electrolytic voltage than the prior art, quantity of electricity is decreased. Heat generation is decreased resulting in the reduction of cooling load. As a result, the cost for anodizing is sharply reduced. It is not necessary to use a power supply equipment having a great voltage elevating ability, the power supply can be compact resulting in the reduction of equipment cost. Since the distance between the web and the electrode can be shortened without the occurrence of quality troubles, electric voltage drop in the electrolyte solution is reduced. The formation of anodized layer on the opposite surface is prevented without providing a special means. In the case that the support is a thin aluminum web, anodizing can be conducted stably without fusion. Anodizing speed and electrolysis quantity can be made high, and supports for a lithographic printing plate excellent in quality can be produced stably.

EXAMPLES

EXAMPLE 1

A first embodiment of an anodizing apparatus according to the present invention is illustrated in FIG. 1. The apparatus is composed of an anodizing bath 11, an electrode 12, a backing roller 15 and two guide rollers 16,17. The inside of the anodizing bath 11 is formed in a semicylindrical form, and the electrode 12 having a circular arc cross-section is provided on the surface so as to be concentric with the backing roller 15. A inlet passage 13 of an electrolyte solution 14 is provided near the right upper edge of the bath 11. The electrolyte solution flows therefrom to fill the space between the electrode 12 and the backing roller 15, and overflows from the left upper edge into a pit provided on the left side of the bath 11. The backing roller 15 is rotatably provided with a clearance of 20 mm, and most of the under half of the backing roller 15 is dipped in the electrolyte solution 14. An upstream guide roller 16 is provided on the left upper side of the backing roller 15 upstream of electrode 12 and a downstream guide roller 17 is provided on the right upper side downstream of electrode 12. Both guide rollers 16,17 are freely rotatable, and connected to the electrode 12 through a power source (not illustrated). The support 18 of aluminum web is engaged so as to travel from the upstream guide roller 16 to the downstream guide roller 17 around and in contact with the backing roller 15. In this state, the web 18 is started to travel by driving to rotate the backing roller 15, and electric current is supplied from the guide rollers 16,17 to the web 18. The electric current flows from the web 18 to the electrode 12 through the electrolyte solution 14, and at that time, anodized layer is formed on the exposed surface of the web 18.

Figure 2:
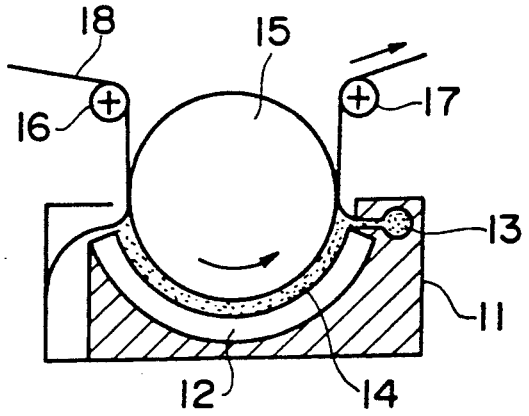

An anodizing apparatus of another embodiment of the present invention is illustrated in FIG. 2. This apparatus is the same as that of FIG. 1, except that the guide rollers 16,17 are disposed so as to contact the surface to be anodized of the web 18.

A JIS 1050 aluminum web 0.15 mm in thickness 1000 mm in width was allowed to travel at 60 m/min, and during traveling, the following treatments were conducted. First, the surface was grained by a rotating nylon brush using pumice water suspension was used as the abrasive material to form a surface roughness of 0.5 μm in center line average height. After washing with water, the surface was etched in 10% sodium hydroxide aqueous solution at 70° C. so that the dissolution quantity of aluminum was 6 g/m$^2$. After washing with water again, the web was neutralized by passing 30% nitric acid aqueous solution followed by washing with water. Then, electrolytic roughening was conducted in 0.7% nitric acid aqueous solution using rectangular alternating waveform (disclosed in Example of Japanese Patent KOKAI No. 52-77702 at an anode voltage of 13 volts a cathode voltage of 6 volts for 20 seconds, and the surface was washed with 20% sulfric acid aqueous solution and then with water.

The above roughened aluminum web was anodized using the apparatus shown in FIG. 1 at a traveling speed of the web of 50 m/min, at an electrolytic voltage of 30 V at an electric supply of 1000 kW. The electrolyte solution was 20% sulfuric acid aqueous solution. The surface temperature of the web at the exit of the backing roller 15 was 50° C., and a good anodized layer 1.5 μm in thickness was formed on the exposed surface of the web. No anodized layer was formed on the opposite surface at all. The anodizing could be continued stably for a long period.

EXAMPLE 2

The same anodizing treatment was conducted as Example 1, except that the traveling speed was increased to 100 m/min, and similar results to Example 1 were obtained.

COMPARATIVE EXAMPLE 1

Figure 4:
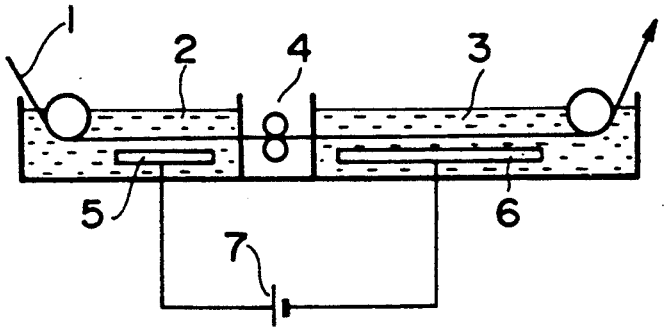
FIG. 4 PRIOR ART
FIG. 4 is a schematic section of a conventional apparatus for anodizing a substrate for a lithographic printing plate.

The same roughened aluminum web as used in Example 1 was anodized using the apparatus shown in FIG. 4 at a traveling speed of 50 m/min, at an electrolytic voltage of 120 V at an electric supply of 5000 kW. The electrolyte solution was 20% sulfuric acid aqueous solution, and the distance between the web 1 and the electrode 6 was 100 mm. The surface temperature of the web at the intermediate part 4 was 120° C., and after about 1 minute from the start of anodizing, the web was cut by fusion. The anodized layer was also formed on the opposite surface of the web.

EXAMPLE 3

Figure 3:
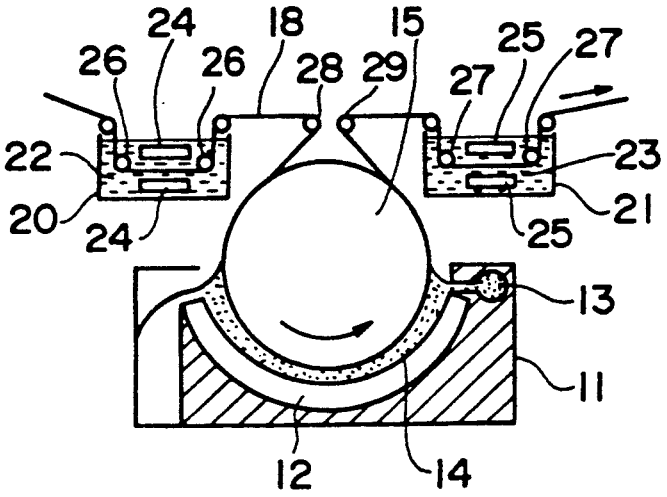
FIG. 3 is a schematic section of an apparatus embodying the invention wherein feeding cells are used as the electric current supplier.

An anodizing apparatus of a third embodiment the present invention is illustrated in FIG. 3. This apparatus is the same as that of FIG. 1, except for the electric supplier. For the electric supplier, two feeding cells 20,21 are provided on both the upstream side and the downstream side of the backing roller 15. Each feeding cell 20,21 is respectively provided with a couple of feeding electrodes 24,25 between which the web 18 passes, and filled with feeding solution 22,23. The support 18 of aluminum web is engaged by guide rollers 26,26 in the feeding cell 20 on the upstream side, roller 28, the backing roller 15, roller 29 and rollers 27,27 in the feeding cell 21 on the downstream side. In this state, the web 18 is started to travel by driving the backing roller 15, and electric current is supplied from the feeding electrodes 24,25 through the feeding solution 22,23.

The same roughened aluminum web as used in Example 1 was anodized using the apparatus shown in FIG. 3 at a traveling speed of the web of 50 m/min, at an electrolytic voltage of 30 V. The electrolyte solution was 20% sulfuric acid aqueous solution. The surface temperature of the web at the exit of the backing roller 15 was 50° C., and a good anodized layer 1.5 μm in thickness was formed on the exposed surface of the web. No anodized layer was formed on the opposite surface at all. The anodizing could be continued stably for a long period, and no spark trouble occurred on the surface of the web.

EXAMPLE 4

The same anodizing treatment was conducted as Example 3, except that the traveling speed was increased to 100 m/min, and similar results to Example 1 were obtained.

COMPARATIVE EXAMPLE 2

The same roughened aluminum web as used in Example 1 was anodized using the apparatus shown in FIG. 2 at a traveling speed of the web of 50 m/min, at an electrolytic voltage of 30 V. The electrolyte solution was 20% sulfuric acid aqueous solution. The surface temperature of the web at the exit of the backing roller 15 was 50° C., and a good anodized layer 1.5 μm in thickness was formed on the exposed surface of the web. The anodizing could be continued for a long period without fusion. However, spark troubles frequently occurred, and the anodized web could not be used as the support for a lithographic printing plate.

We claim:

1. An apparatus for anodizing one side of a support for a lithographic printing plate, said support comprising a web made of aluminum or an alloy thereof, said apparatus comprising:

a backing roller which guides said web in a state of contacting the backing roller;

at least one electrode which is arranged along the peripheral surface of the backing roller in a concentric arc acting as a cathode;

at least two guide rollers, which contact said web, for feeding electric current directly to said web, at least one of said guide rollers being provided upstream from the backing roller with respect to a direction in which said web travels, at least one of said guide rollers being provided downstream from said backing roller with respect to said direction in which said web travels; and an electrolyte solution which substantially fills the space between the backing roller and the electrode for establishing electrical contact between said web and said electrode, wherein said side of said web to be anodized is a side facing said electrode in a portion of said web disposed in said electrolyte solution.

2. The apparatus of claim 1, wherein said guide rollers are arranged to touch the surface of the web so that the web contacts the backing roller.

3. An apparatus for anodizing one side of a substrate for a lithographic printing plate, said support comprising a web made of aluminum or an alloy thereof, said apparatus comprising:

a backing roller which guides said web in a state of contacting the backing roller;

at least one electrode which is arranged along the peripheral surface of the backing roller in a concentric arc acting as a cathode;

at least two feeding cells, each feeding cell including a pair of feeding electrodes between which said web passes and being filled with feeding electrolyte solution for establishing electrical contact between said web and said feeding electrodes, at least one of said feeding cells provided upstream from the backing roller, at least one of said feeding cells being provided downstream from said backing roller with respect to a direction in which said web travels;

an electrolyte solution which substantially fills the space between the backing roller and the electrode for establishing electrical contact between said web and said electrode; and wherein said side of said web to be anodized is a side facing said electrode in a portion of said web disposed in said electrolyte solution.

4. The apparatus of claim 1 or 3 wherein the distance between the backing roller and the electrode is 1 to 40 mm.

5. A method of anodizing one side of a support for a lithographic printing plate, said support comprising a web made of aluminum or an alloy thereof, comprising the steps of:

guiding said web with said web contacting a backing roller being dipped in an electrolyte solution;

supplying electric current to at least one electrode which is arranged along the peripheral surface of the backing roller in a concentric arc acting as a cathode; and supplying electric current to at least two electric suppliers, at least one of said electric suppliers being provided upstream from the backing roller with respect to a direction in which said web travels, at least one of said electric suppliers provided downstream from said backing roller with respect to said direction in which said web travels, wherein an electrolyte solution substantially fills the space between the backing roller and the electrode for establishing electrical contact between said web and said electrode, and wherein said side of said web to be anodized is a side facing said electrode in a portion of said web disposed in said electrolyte solution.

6. The method of claim 5 wherein each of said electric suppliers comprises at least one guide roller contacting the web.

7. The method of claim 5 wherein each of said electric suppliers comprises a feeding cell including a pair of feeding electrodes between which said web passes and being filled with feeding electrolyte solution for establishing electrical contact between said feeding electrodes and said web.

8. The method of claim 6 wherein said guide rollers are arranged to touch the surface of the web so that the web contacts the backing roller.

* * * * *